United States Patent [19]

Snell

[11] 4,242,102

[45] Dec. 30, 1980

[54] PRODUCTION OF GASIFIED PRODUCTS FROM ASH CONTAINING BITUMEN PRODUCED IN COAL LIQUEFACTION

[75] Inventor: George J. Snell, Fords, N.J.

[73] Assignee: The Lummus Company, Bloomfield, N.J.

[21] Appl. No.: 969,725

[22] Filed: Dec. 15, 1978

[51] Int. Cl.[3] ..... C10J 3/46

[52] U.S. Cl. ..... 48/197 R; 208/8 LE; 208/8 R

[58] Field of Search ..... 208/8 R, 8 LE; 44/10 C, 44/10 F; 48/197 R, 210, 203; 210/72, 73 R

[56] References Cited

U.S. PATENT DOCUMENTS

| | | | |
|---|---|---|---|
| 2,761,772 | 9/1956 | Atwell | 48/203 |
| 3,808,119 | 4/1974 | Bull et al. | 208/8 LE |
| 3,852,183 | 12/1974 | Snell | 208/8 LE |
| 3,920,418 | 11/1975 | Rice | 48/210 |
| 4,008,054 | 2/1977 | Clancey et al. | 208/8 LE |
| 4,075,079 | 2/1978 | Lang | 208/8 LE |
| 4,138,223 | 2/1979 | Gorin | 44/10 C |
| 4,146,459 | 3/1979 | Burke | 208/8 LE |

*Primary Examiner*—S. Leon Bashore
*Assistant Examiner*—Michael L. Goldman
*Attorney, Agent, or Firm*—Louis E. Marn; Elliot M. Olstein

[57] ABSTRACT

An ash containing heavy bitumen recovered from the deashing step of a coal liquefaction process is subjected to vacuum flashing to provide a residual product having a softening point of no less than 350° F. and no greater than 550° F. Subsequently, the flashed product is solidified and pulverized so that 100 percent passes through a 100 mesh screen. The pulverized fraction, without prior coking thereof, is entrained in a gas stream and then subjected to gasification.

7 Claims, 2 Drawing Figures

Figure 1:
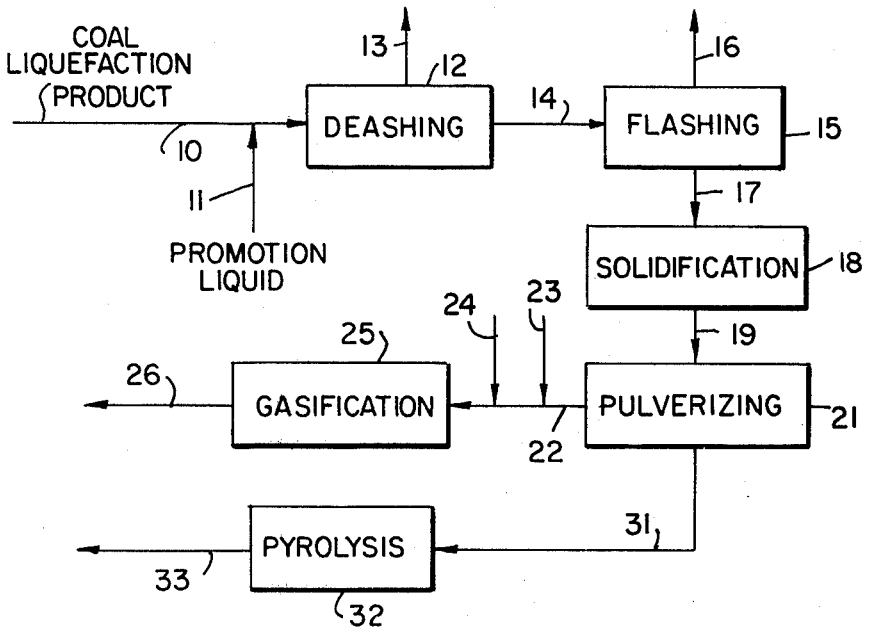

PRODUCTION OF GASIFIED PRODUCTS FROM ASH CONTAINING BITUMEN PRODUCED IN COAL LIQUEFACTION

This invention relates to coal liquefaction, and more particularly to producing a gas product from an ash containing bitumen stream generated in a coal liquefaction process.

Coal can be converted to valuable products by subjecting coal to solvent extraction, with or without hydrogen, to produce a mixture of a coal extract and undissolved coal residue, including undissolved extractable cabonaceous matter, fusain and mineral matter and ash. The undissolved coal residue is separated from the coal extract as a heavy bitumen stream. The present invention is directed to the utilization of such ash containing heavy bitumen fraction for the production of valuable gas products.

In accordance with the present invention, the ash containing heavy bitumen fraction recovered from the deashing step of a coal liquefaction process is subjected to vacuum flashing to provide a residual product having a softening point of no less than 350° F. and no greater than 550° F. Subsequent to the flashing, the residual product is solidified and pulverized to a particle size so that 100 percent passes through a 100 mesh screen. The pulverized residual product is then converted to valuable gas products by either a gasification process of the type employed for effecting gasification of coal or by a pyrolysis process of the type employed for effecting pyrolysis of coal.

More particularly, the residual product recovered from the vacuum flashing operation which has a softening point of at least 350° F., and no greater than 550° F., preferably a softening point in the order of from 400° to 500° F., has an ash content in the order of from about 15 percent to about 45 percent, most generally in the order of from about 20 percent to about 40 percent, all by weight. The flashing of the ash containing bitumen to produce the residual product having the desired characteristics is generally effected at a temperature in the order of from about 550° F. to about 650° F., and at a pressure in the order of from 25 mmHg Abs to about 100 mmHg Abs. The flashed product is withdrawn from the vacuum flashing apparatus at an elevated temperature, normally at least 25° F. above its softening point, and preferably at least 50° F. above its softening point.

The flashed residual product is then solidified by a procedure known in the art, such as continuous prilling or flaking. The solidified residual product is then pulverized, by procedures known in the art, such that 100 percent passes through a 100 mesh screen, and preferably to a particle size so that at least 80 percent passes through a 200 mesh screen.

In subjecting the pulverized residual product to gasification, such pulverized solids are entrained in steam as a gasification gas which includes oxygen. The entrained solids are conveyed as a dilute phase fluidized mixture into gasification apparatus of a type known in the art. In general, the gasification is effected at a temperature in the order of from about 1800° F. to about 3000° F., preferably 2000° F. to 2800° F., and a pressure of from about 25 to about 3000 psig, preferably 50 to 1000 psig. The gasification product contains hydrogen and carbon monoxide, as well as carbon dioxide, gaseous sulfur compounds, some methane and entrained char like solids. The gasification procedures are generally known in the art, and such procedures are applicable to the feed produced in accordance with the present invention.

Alternatively, gas products may be produced from the feed produced in accordance with the present invention by a coal pyrolysis procedure of the type known in the art. In general, such pyrolysis is effected at a temperature in the order of from about 750° F. to 1500° F. at a pressure of from 0 to 100 psig to produce a pyrolysis gas. The pyrolysis may be effected, as known in the art, with or without the presence of steam or with or without the presence of oxygen or air. These pyrolysis procedures are known in the art, and such procedures are applicable to the feed produced in accordance with the present invention. The pyrolysis gas contains hydrogen, carbon monoxide, as well as carbon dioxide, gaseous sulfur compounds, and some methane.

Although the ash containing bitumen fraction may be produced in any one of a wide variety of known deashing procedures for removing ash containing solids from a coal liquefaction product, such ash containing bitumen fraction is preferably produced in accordance with the deashing procedure described in U.S. Pat. Nos. 3,856,675 or 3,852,182. In accordance with such a procedure, the coal liquefaction product, comprised of a liquid coal extract of dissolved carbonaceous matter in a coal liquefaction solvent and insoluble material is mixed with a liquid promoter having an aromaticity less than that of the liquefaction solvent to enhance and promote the separation of insoluble material and provide a liquid coal extract essentially free of insoluble material, and an ash containing liquid bitumen fraction. The promoter liquid which is employed to enhance and promote the separation of insoluble material from the coal liquefaction product is generally a hydrocarbon liquid having a characterization factor (K) of at least about 9.75, and preferably at least about 11.0 wherein:

$$K=\sqrt[3]{T_{B/G}}$$

Wherein $T_B$ is the molal average boiling point of the liquid (°R); and G is specific gravity of the liquid (60° F./60° F.). The liquid is further characterized by a 5 volume percent distillation temperature of at least about 250° F. and a 95 volume percent distillation temperature of at least about 350° F. and no greater than about 750° F. The separation is preferably effected by a gravity settling separation technique. The details with respect to deashing of a coal liquefaction product with the use of such a promoter liquid is described in more detail in the aforesaid U.S. patents, which are hereby incorporated by reference.

Figure 2:
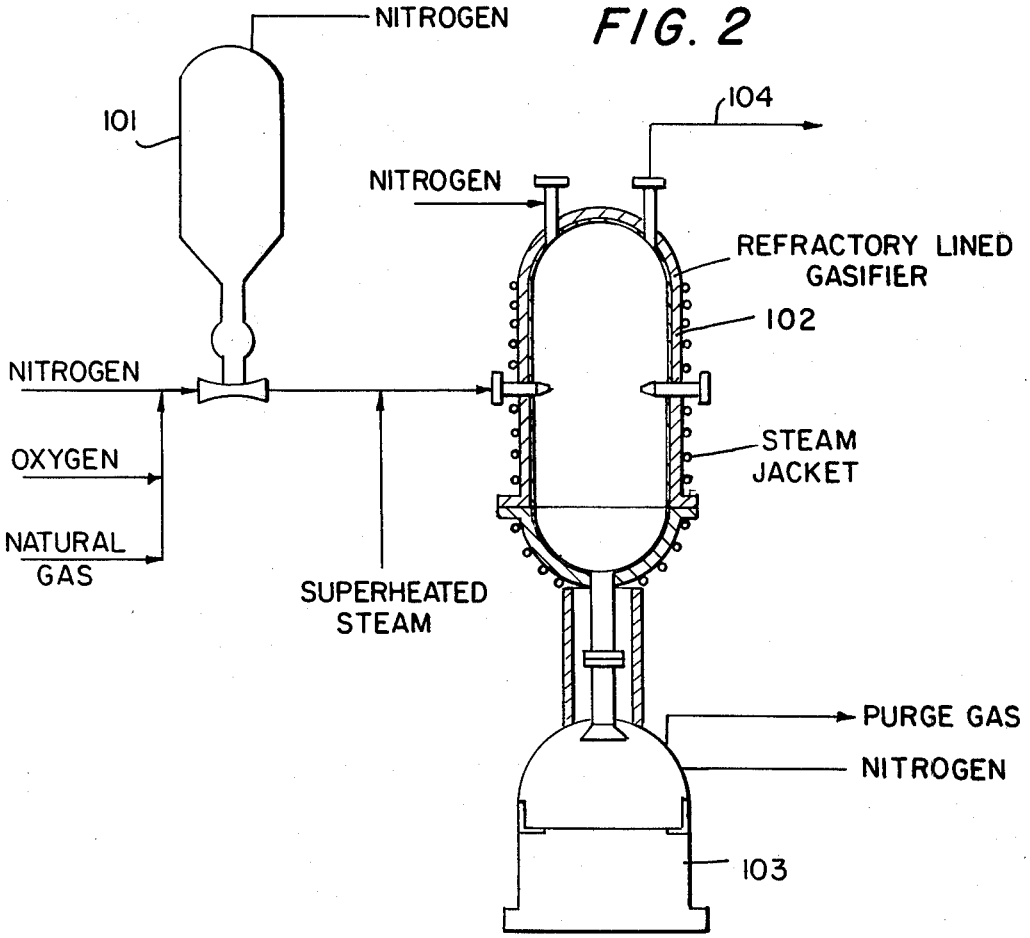

The invention will be further described with respect to the accompanying drawing, wherein:

FIG. 1 is a simplified schematic block diagram of an embodiment of the present invention, and FIG. 2 is a simplified schematic drawing of gasification equipment for effecting gasification of solid product.

Referring to FIG. 1, a coal liquefaction product, comprised of a liquid coal extract of dissolved carbonaceous matter in a coal liquefaction solvent, and insoluble material (ash and undissolved coal) in line 10 and a promoter liquid, in line 11, of the type hereinabove described, are introduced into a coal deashing zone 12. The coal deashing zone 12 is preferably comprised of one or more gravity settlers. In the deashing zone 12, there is produced a liquid product essentially free of insoluble material, which is withdrawn therefrom through line 13 for further treatment. In addition, there is produced an ash containing solid heavy bitumen fraction which is withdrawn from the deashing zone 12 through line 14.

The ash containing heavy bitumen fraction in line 14 is introduced into a vacuum flashing unit, schematically indicated as 15, wherein the bitumen fraction is subjected to vacuum flashing to produce a residual product having the hereinabove described characteristics.

The flashed material is withdrawn from zone 15 through line 16, and forms part of the net ash free product produced in the liquefaction process.

The residual product is withdrawn from the flashing zone 15 through line 17, as a liquid fraction, with such fraction generally being at a temperature of at least 50° F. above the solidification point thereof. The fraction in line 17 is then introduced into a solidification zone, schematically indicated as 18 wherein the fraction is solidified by a technique known in the art, such as continuous prilling or flaking.

The solidified product is withdrawn from solidification zone 18 through line 19 and introduced into a pulverizing zone 21 wherein the solidified product is pulverized to a particle size such that 100 percent passes through a 100 mesh screen.

In accordance with the present invention, such pulverized product may then be converted to valuable gaseous products by either a gasification technique or a pyrolysis technique. If the pulverized product is to be gasified, such pulverized product, in line 22 is entrained in steam in line 23 for transportation to a gasification zone as a dilute fluidized solid phase. Oxygen and/or air in line 24 may be combined with such a stream.

The solidified product entrained in steam, and further containing air and/or oxygen is introduced into a gasification zone schematically generally indicated as 25 wherein such stream is subjected to gasification by procedures known in the art to produce a valuable gasification product recovered through line 26.

Alternatively, the pulverized product from pulverizing zone 21 may be passed through line 21 into a pyrolysis unit, schematically generally indicated as 32. As known in the art, such pyrolysis may be effected in the presence or absence of steam or in the presence or absence of air or oxygen. Valuable gaseous products are recovered from the pyrolysis operation through line 33.

The present invention will be further described with respect to the following example; however, the scope of the invention is not to be limited thereby:

EXAMPLE

The coal liquefaction product of Table 1 is deashed in accordance with the procedure of U.S. Pat. No. 3,856,675 and the ash containing underflow is atmospherically flashed in a single stage flash unit (about 550° F.), followed by deep vacuum flashing in a single stage continuous vacuum flash unit operating at 15 mm Hg absolute pressure and a temperature of 580° F. to provide the ash containing heavy bitumen of Table 2.

TABLE 1

| COAL LIQUEFACTION PRODUCT | |
|---|---|
| Specific Gravity 60°/60° F. | 1.185 |
| Ash content, wt % | 3.85 |
| Quinoline Insolubles Content, wt % | 5.67 |
| Benzene Insolubles Content, wt % | 9.76 |

TABLE 1-continued

| COAL LIQUEFACTION PRODUCT | |
|---|---|
| +850° F. Distillation Residue, wt % | 26.43 |

TABLE 2

| STRIPPED ASH CONTAINING BITUMEN | |
|---|---|
| Softening Point (ASTM Ring & Ball), °F. | 422 |
| Quinoline Insolubles, Wt % | 44.6 |
| Benzene Insolubles, Wt % | 58.7 |

The ash containing bitumen is pumped onto a moving metal belt, air cooled flaker to effect solidification thereof. After cooling for about 16 hours, the solids are pulverized to substantially minus 100 mesh.

The pulverized solids are gasified in a continuous refractory lined, bench scale entrained bed gasifier, operated at a temperature of 2600°–2700° F. and pressure of 120 psig. The solid feed rate is 11 lbs./hr, oxygen feed rate 5.6 lbs./hr and the steam feed rate 18.1 lbs./hr. The solids are effectively gasified, with an inspection of the resulting ash indicating about 5.3 wt% carbon. The gasifier employed is shown in simplified form in FIG. 2, with the solidified ash containing bitumen from lock hopper 101 being entrained in a gaseous mixture of nitrogen, oxygen and steam for introduction into gasifier 102. Ash produced in gasifier 102 is collected in vessel 103 and gasified product is withdrawn through line 104.

The present invention is particularly advantageous in that valuable products can be produced from the ash containing heavy bitumen produced in a coal liquefaction process. Applicant has found that such ash containing heavy bitumen can be solidified and employed as a solid feed to a coal gasification process, without the necessity of effecting prior coking to produce such a solid gasification feed. As generally practiced in the art, the solid feeds to a gasification process are either coal or coke. Moreover, by converting the ash containing bitumen to a solid feedstock, the problems associated with attempting to provide a liquid feedstock in suitable form for gasification, in particular, atomization thereof, are avoided. Thus, in accordance with the present invention, the ash containing heavy bitumen recovered from a coal liquefaction process is converted to valuable gaseous products, without the problems which would be encountered in attempting gasification thereof as a liquid feedstock. In addition, it was surprising that such ash containing heavy bitumen could be employed, as a solid feed, without prior coking thereof.

Numerous modifications and variations of the present invention are possible in light of the above teachings and, therefore, within the scope of the appended claims, the invention may be practised otherwise than as particularly described.

I claim:

1. In a process for the liquefaction of coal wherein an essentially ash free liquid coal fraction is separated from an ash containing heavy bitumen fraction, the improvement comprising:

subjecting said ash containing bitumen fraction to vacuum flashing to provide a residual product having a softening point of no less than 350° F. and no greater than 550° F.;

solidifying said residual product;

pulverizing the solidified residual product to a particle size such that 100 percent passes through a 100 mesh screen; and employing said pulverized solidified residual product, without prior coking thereof as feed to an entrained bed gasification process by entrainment in a gasification gas to produce gaseous product therefrom.

Reconsideration and allowance of this application are requested.

2. The process of claim 1 wherein the residual product has an ash content of from 15 to 45 percent, by weight.

3. The process of claim 2 wherein the vacuum flashing is effected at a temperature of from 550° F. to 650° F. and a pressure of from 25 mm Hg to 100 mm Hg, absolute.

4. The process of claim 2 wherein the gasification is effected with steam and oxygen at a temperature of from 1800° F. to 3000° F. and a pressure of from 50 to 1000 psig.

5. The process of claim 1 wherein the softening point of the residual product is from 400° to 500° F.

6. The process of claim 5 wherein the ash content of the residual product is from 20 to 40 percent by weight.

7. The process of claim 1 wherein the ash containing heavy bitumen is separated from the ash free liquid coal fraction by gravity settling in the presence of a promoter liquid having a characterization factor of at least 9.75, a 5 volume percent distillation temperature of at least 250° F. and a 95 percent distillation temperature of at least 350° F. and no greater than 750° F.

* * * * *